US011092398B2

(12) United States Patent
Slack

(10) Patent No.: US 11,092,398 B2
(45) Date of Patent: Aug. 17, 2021

(54) FIREARM SUPPRESSOR

(71) Applicant: Michael B. Slack, Viroqua, WI (US)

(72) Inventor: Michael B. Slack, Viroqua, WI (US)

( * ) Notice: Subject to any disclaimer, the term of this patent is extended or adjusted under 35 U.S.C. 154(b) by 0 days.

(21) Appl. No.: 16/111,066

(22) Filed: Aug. 23, 2018

(65) Prior Publication Data

US 2019/0072353 A1 Mar. 7, 2019

Related U.S. Application Data

(63) Continuation of application No. 15/256,219, filed on Sep. 2, 2016, now Pat. No. 10,060,695.

(60) Provisional application No. 62/283,539, filed on Sep. 4, 2015.

(51) Int. Cl.
*F41A 21/30* (2006.01)
*F41A 21/24* (2006.01)
*F41A 21/34* (2006.01)

(52) U.S. Cl.
CPC ..... *F41A 21/30* (2013.01); *F41A 21/24* (2013.01); *F41A 21/34* (2013.01)

(58) Field of Classification Search
CPC ..... F41A 21/30; F41A 21/24; F41A 21/34; F41A 21/36
USPC ..... 89/14.1–14.5
See application file for complete search history.

(56) References Cited

U.S. PATENT DOCUMENTS 1,341,363 A 5/1920 Fiala
1,342,978 A 6/1920 Young
1,667,186 A 4/1928 Bluehdom
1,770,471 A * 7/1930 Hatcher ..... F41A 21/30 89/14.3
1,901,138 A * 3/1933 Barnes ..... F41A 21/30 89/14.3
2,351,037 A * 6/1944 Green ..... F41A 21/34 89/14.5
2,359,365 A * 10/1944 Katcher ..... F01N 1/12 181/280
2,457,802 A 1/1949 Bauer
2,503,491 A * 4/1950 Janz ..... F41A 21/30 181/223
2,792,760 A 5/1957 Hammer
3,500,955 A * 3/1970 Werbell ..... F41A 21/30 181/223
3,667,570 A 6/1972 Werbell, III
4,907,488 A 3/1990 Seberger
(Continued)

*Primary Examiner* — Joshua E Freeman
(74) *Attorney, Agent, or Firm* — Seager, Tufte & Wickhem, LLP

(57) ABSTRACT

Disclosed herein are suppressors for use with firearms or the like, and methods of making and using such suppressors. The suppressor may include a body defining a central bore extending from a proximal end to a distal end about a central longitudinal axis. The body includes a proximal body segment defining a proximal bore segment configured to receive a distal end of a barrel of a firearm, and a distal body segment defining a distal bore segment. The body includes a wall having an inner surface defining the bore, and having an outer surface. The wall defines at least one channel extending through the wall from the inner surface in the proximal bore segment to the outer surface in the distal body segment. Some examples include a canted helical portion extending helically around a cylindrical body portion. Some examples include one or more cooling bores spaced from the central bore.

19 Claims, 10 Drawing Sheets

(56) References Cited

U.S. PATENT DOCUMENTS

| | | | | |
|---|---|---|---|---|
| 5,029,512 | A * | 7/1991 | Latka | F41A 21/30 181/223 |
| 5,136,923 | A * | 8/1992 | Walsh, Jr. | F41A 21/30 89/14.2 |
| 5,357,842 | A | 10/1994 | Reynolds | |
| 6,298,764 | B1 | 10/2001 | Sherman et al. | |
| 6,308,609 | B1 | 10/2001 | Davies | |
| 7,308,967 | B1 * | 12/2007 | Hoel | F41A 21/30 181/223 |
| 8,292,025 | B1 | 10/2012 | Woodell et al. | |
| 8,424,635 | B1 | 4/2013 | Klawunn | |
| 8,826,793 | B2 | 9/2014 | Oliver | |
| 8,991,551 | B2 | 3/2015 | Latka | |
| 9,134,084 | B1 * | 9/2015 | Harrison | F41A 21/36 |
| 2004/0244571 | A1 | 12/2004 | Bender | |
| 2010/0126334 | A1 | 5/2010 | Shults et al. | |
| 2012/0272818 | A1 * | 11/2012 | Dueck | F41A 21/325 89/14.4 |
| 2012/0291614 | A1 | 11/2012 | Koumbis | |
| 2013/0233162 | A1 | 9/2013 | Schneider | |
| 2014/0224574 | A1 * | 8/2014 | Latka | F41A 21/30 181/223 |
| 2015/0136519 | A1 * | 5/2015 | Moore | F41A 21/44 181/223 |
| 2017/0067711 | A1 | 3/2017 | Slack | |

* cited by examiner

FIREARM SUPPRESSOR

CROSS-REFERENCE TO RELATED APPLICATIONS

This application is a continuation of U.S. application Ser. No. 15/256,219, filed Sep. 2, 2016, now U.S. Pat. No. 10,060,695; which claims priority under 35 U.S.C. § 119 to U.S. Provisional Application Ser. No. 62/283,539 filed Sep. 4, 2015, the entire disclosures of which are incorporated herein by reference.

TECHNICAL FIELD

The present disclosure pertains to suppressors, and methods for using and manufacturing the same. More particularly, the present disclosure pertains to a suppressor for attachment to a weapon, such as a firearm or the like, and methods for manufacturing and using such devices.

BACKGROUND

Firearms produce a loud concussive sound and bright flash when a projectile leaves the distal end or muzzle of a firearm barrel when fired. This "firing" produces a tremendous amount of expanding gases and subsequent heat, caused from the combustion of the propellant used in the firearm to accelerate a projectile.

Suppressors, for use with various firearms, are generally known. Suppressors may absorb, dissipate and/or reduce the audible frequencies and muzzle flash from firing a firearm. One common mechanism of firearm suppressors is to incorporate a series of baffles into an external housing. However, such configurations are not always as effective as desired. As such, there is a continuing need to develop additional firearm suppressors.

BRIEF SUMMARY

This disclosure relates to firearm suppressors, and design, material, manufacturing method, and use alternatives for such firearm suppressors.

Some example embodiments relate a firearm suppressor comprising a cylindrical body portion including a proximal end designed to be coupled to a firearm and a distal end. The cylindrical body portion defines a bore extending along a central longitudinal axis from the proximal end to the distal end. The firearm suppressor may also include a helical portion extending helically around the cylindrical body portion, at least a section of the helical portion being canted such that it extends radially outward from the cylindrical body portion at an oblique angle relative to a plane normal to the central longitudinal axis. In some examples, the helical portion is canted distally.

In some embodiments, the helical portion includes a distal surface and a proximal surface, wherein both the distal surface and the proximal surface are canted such that they extend radially outward from the cylindrical body portion at an oblique angle relative to a plane normal to the longitudinal axis. In some cases, the distal surface is canted distally, and the proximal surface is canted distally. Additionally or alternatively, in some examples, the distal surface and the proximal surface are canted at the same oblique angle relative to a plane normal to the longitudinal axis. In other cases, the distal surface and the proximal surface are canted at different oblique angles relative to a plane normal to the longitudinal axis.

In some embodiments, the helical portion defines a crest furthest from the cylindrical body portion, and a base closest to the cylindrical body portion, and wherein the helical portion is canted such that a line drawn from the central longitudinal axis, through a midpoint of the base, and through the midpoint of the crest defines an oblique angle relative to a plane normal to the central longitudinal axis.

Additionally or alternatively, the cylindrical body portion may include a cylindrical wall including an inner surface defining the lumen, and an outer surface, the cylindrical wall defining at least one channel extending through the cylindrical wall from the inner surface to the outer surface. In some cases, the at least one channel is canted at an oblique angle relative to a plane normal to the central longitudinal axis. In some cases, the helical portion defines a crest and a root, and wherein the one or more channels open into the root of the helix.

In some embodiments, the helical portion defines a plurality of helical turns extending helically around the cylindrical body portion, each turn extending 360 degrees around the body portion.

In some embodiments, the entire the helical portion is canted at an oblique angle relative to a plane normal to the longitudinal axis of the cylindrical body portion.

The firearm suppressor may further include an outer cylindrical housing portion disposed over at least a part of the helical portion.

In another respect, some example embodiments relate to a firearm suppressor including a cylindrical body portion including a proximal end designed to be coupled to a firearm and a distal end. The cylindrical body portion extends along a central longitudinal axis from the proximal end to the distal end, and the cylindrical body portion defines a bore extending from the proximal end to the distal end about the longitudinal axis. A helical portion extends radially outward from and helically around the body portion to define a crest and a root. The cylindrical body portion includes a cylindrical wall, the cylindrical wall defines at least one channel extending from an inner opening along the bore to an outer opening along the root of the helical portion.

In some cases, the at least one channel is canted at an oblique angle relative to a plane normal to the central longitudinal axis.

In some cases, the at least one channel is canted distally at an oblique angle relative to a plane normal to the central longitudinal axis, such that a center of the outer opening is distal to a center of the inner opening.

In some embodiments, the body portion defines a plurality of channels extending from the bore to the root.

Yet additional other embodiments relate to a firearm suppressor including a cylindrical body portion including a cylindrical wall having a proximal end designed to be coupled to a firearm and a distal end. The cylindrical wall extending along a central longitudinal axis from the proximal end to the distal end, the cylindrical wall defining a central bore extending from the proximal end to the distal end about the longitudinal axis. The proximal end of the cylindrical wall defines one or more cooling bores spaced from the central bore, the cooling bores extending into the annular wall offset from the central longitudinal axis.

The above summary of some embodiments is not intended to describe each disclosed embodiment or every implementation of the present disclosure. The Figures, and Detailed Description, which follow, more particularly exemplify some of these embodiments.

BRIEF DESCRIPTION OF THE DRAWINGS

The disclosure may be more completely understood in consideration of the following detailed description in connection with the accompanying drawings, in which.

Figure 1:
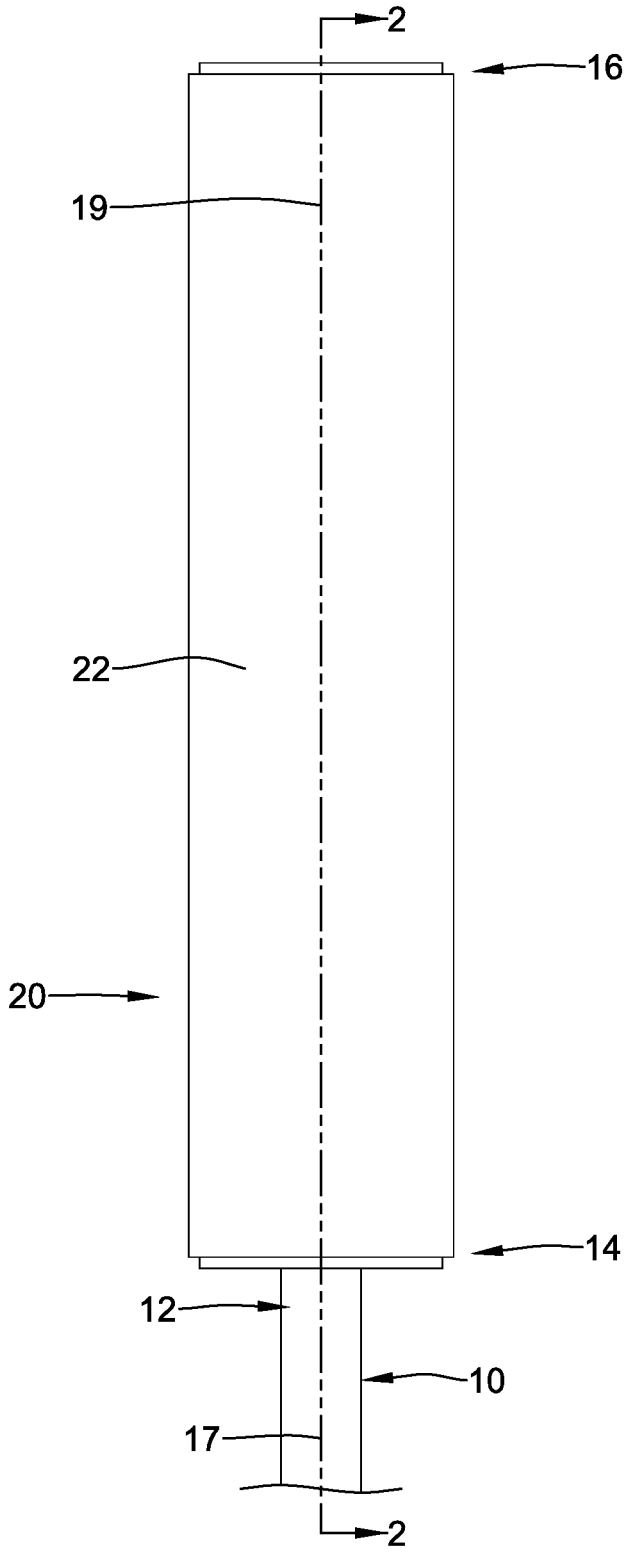
FIG. 1 is a side view of firearm suppressor shown attached to the distal end of a firearm barrel.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used in connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the invention.

Figure 2:
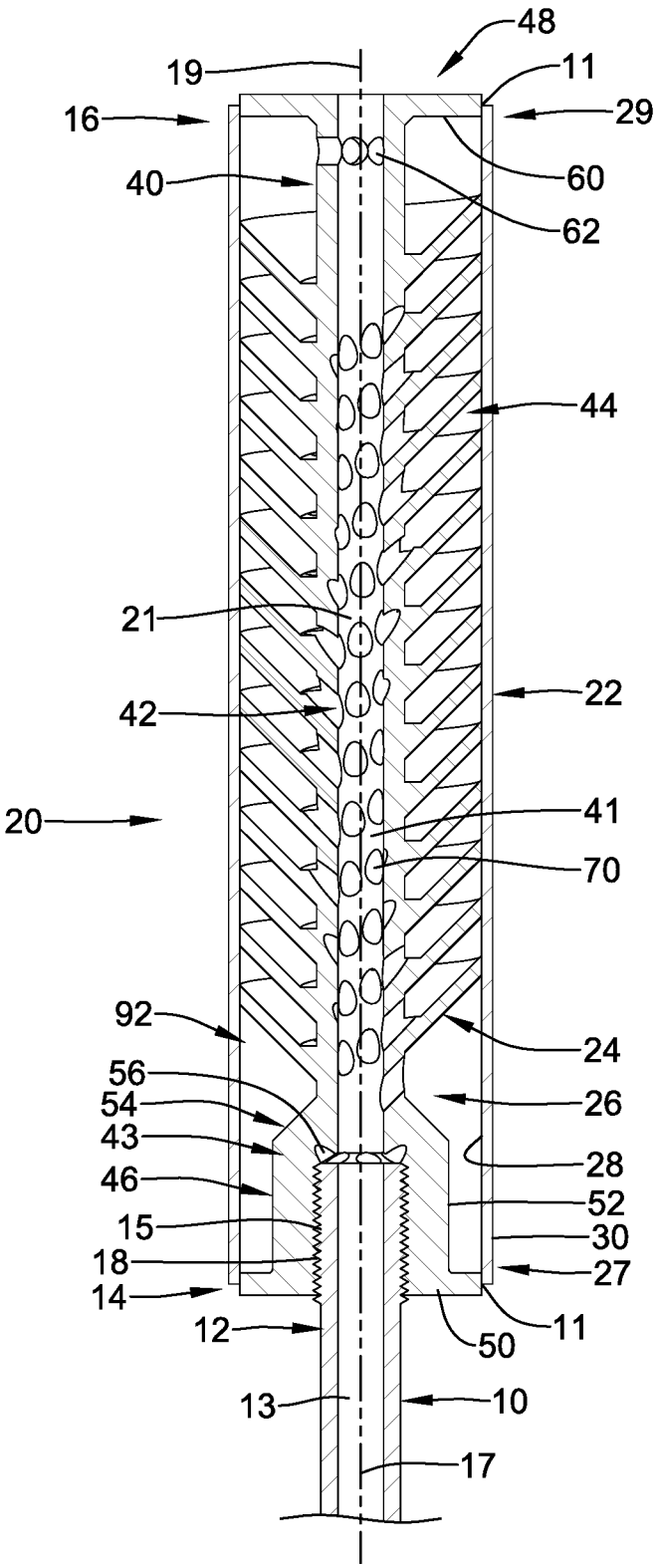
FIG. 2 is a cross-sectional side view of the example firearm suppressor attached to the distal end of a firearm barrel of FIG. 1.
Figure 3:
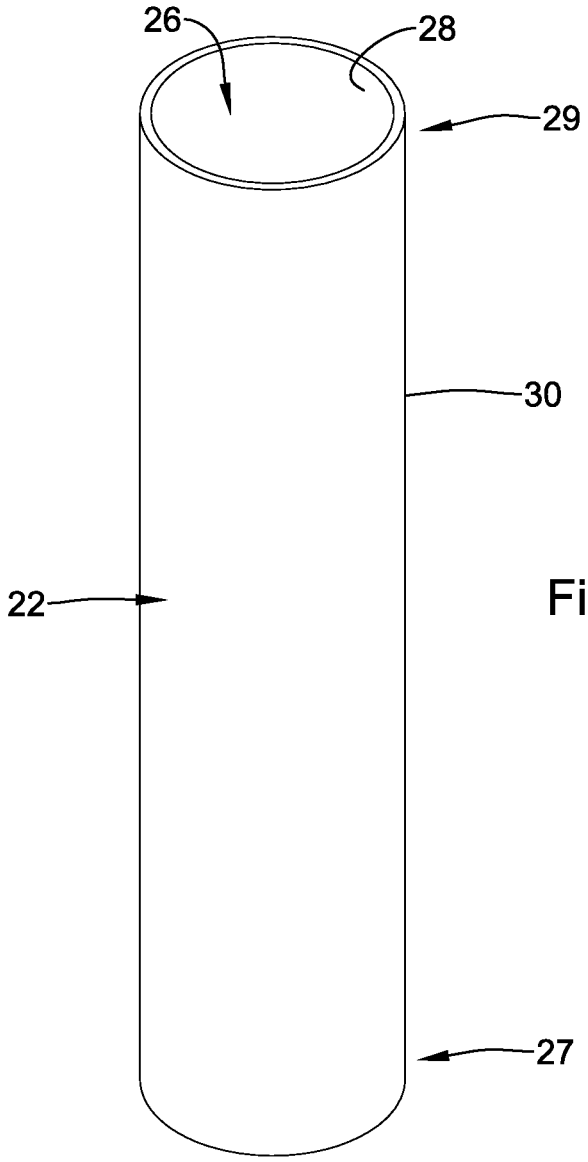
FIG. 3 is a perspective view of an external component or housing of the firearm suppressor of FIG. 1, removed from an inner component of the firearm suppressor.
Figure 4:
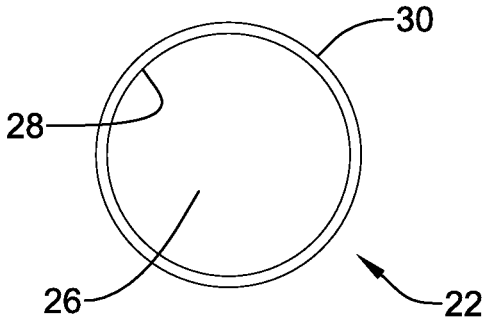
FIG. 4 is an end view the external component of the firearm suppressor of FIG. 1, removed from the inner component.
Figure 5B:
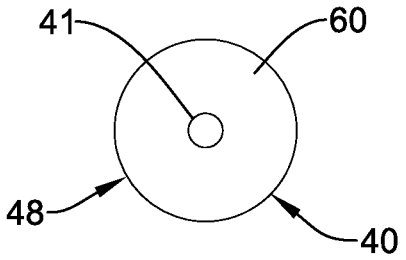
FIG. 5B is a distal end view of the internal component of the firearm suppressor of FIG. 1, removed from the outer component.
Figure 5:
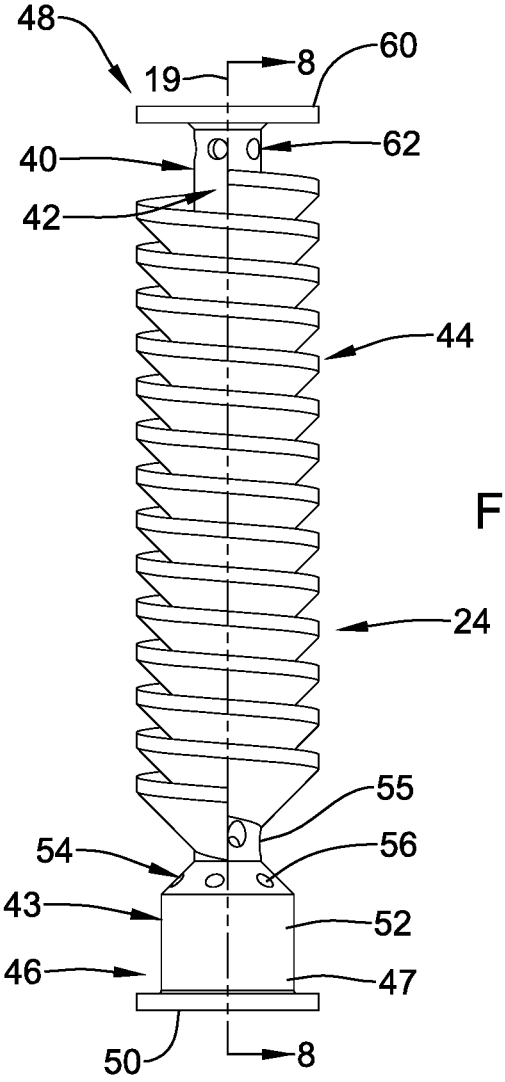
FIG. 5 is a side view of an internal component of the firearm suppressor of FIG. 1, removed from the outer component.
Figure 5A:
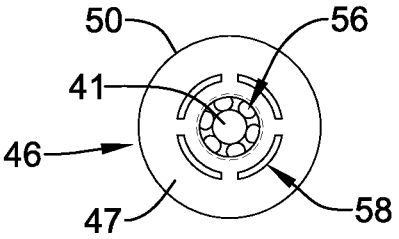
FIG. 5A is a proximal end view of the internal component of the firearm suppressor of FIG. 1, removed from the outer component.
Figure 6:
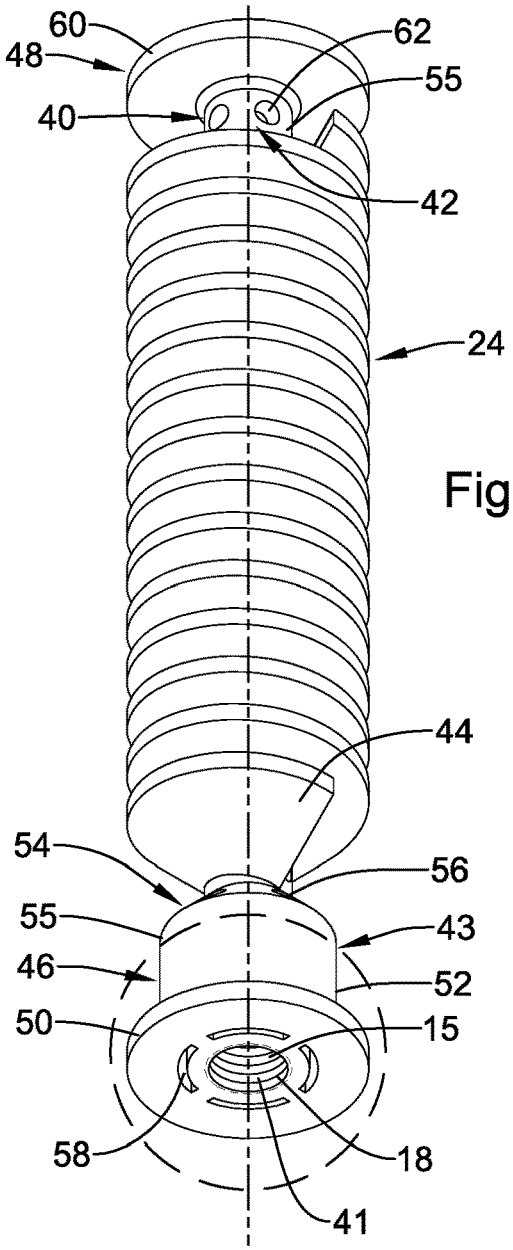
FIG. 6 is a perspective view of the internal component of the firearm suppressor of FIG. 1, removed from the outer component.
Figure 6A:
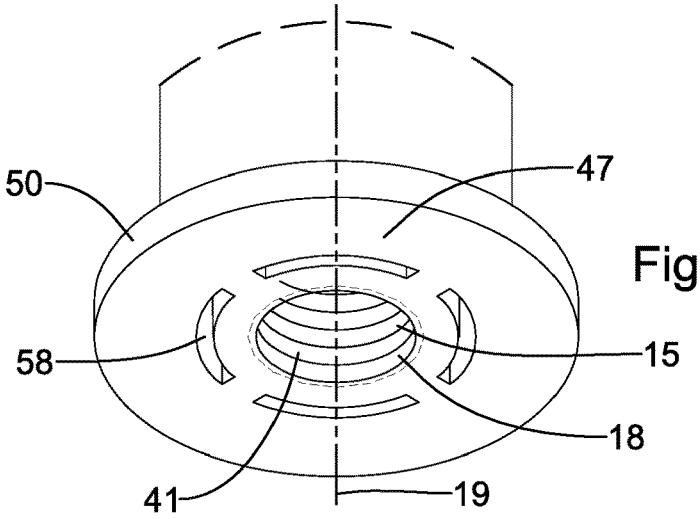
FIG. 6A is an expanded perspective view of the proximal portion of the internal component shown in FIG. 6.
Figure 7:
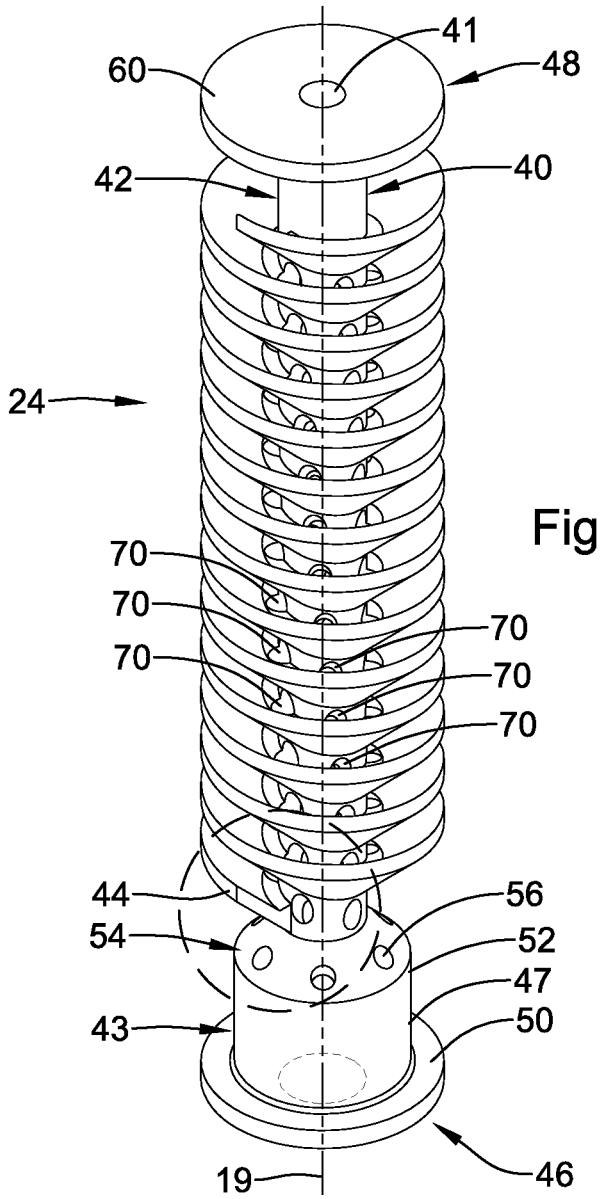
FIG. 7 is another perspective view shown from a different angle of the internal component of the firearm suppressor of FIG. 1, removed from the outer component.
Figure 7A:
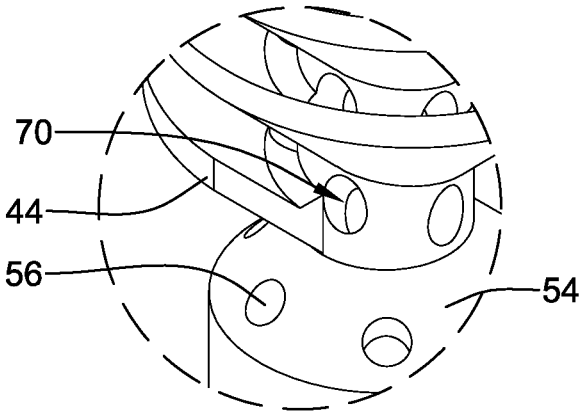
FIG. 7A is an expanded perspective view of a portion of the internal component shown in FIG. 7.

FIG. 1 shows a side view of an example embodiment of a firearm suppressor 20 including a proximal end 14 designed to be couple to a firearm, and a distal end 16. The proximal end 14 of the firearm suppressor 20 is shown coupled to or attached to the distal end 12 of a firearm barrel 10. FIG. 2 shows a side cross-sectional view of the firearm suppressor 20 attached to the distal end 12 of a firearm barrel 10. The firearm suppressor 20 includes an external component or housing 22 and an internal component 24. The external component 22 may include or be made of a generally cylindrical member including an outer surface 30, an inner surface 28, and defining an inner lumen 26 designed to house at least a portion of the internal component 24. The external component 22 includes a proximal end 27 and a distal end 29. FIG. 3 shows a perspective view of the external component 22, and FIG. 4 shows an end view of the external component 22.

As shown in FIG. 2, at least a portion of the internal component 24 is disposed or housed within the lumen 26 of the external component 22. When the internal component 24 is disposed within the external component 22, the empty space left open within the lumen 26 of the external component 22 between the cylindrical body portion 40 and the inner surface of the external component 22 the defines an attenuation chamber 92. The internal component 24 includes an annular or cylindrical body portion 40 defining a bore 41, and a helical portion 44 extending helically around the cylindrical body portion 40. The cylindrical body portion 40 may also define or include one or more channels that extend from the bore 41 through the cylindrical body portion 40 and into the attenuation chamber 92, to allow for fluid communication between the bore 41 and the attenuation chamber 92. Some examples of such channels include channels 56, 70 and 62. The helical portion 44 and the channels 56, 70 and 62 will be discussed in greater detail below.

FIG. 2 shows the internal component 24 within the external component 22, and FIGS. 5-8A show various views of the internal component 24 with the external component 22 removed. The internal component 24 includes a proximal end 46 designed to be coupled to a firearm, and a distal end 48. The internal component 24, including the cylindrical body portion 40 defining the bore 41, extends along a central longitudinal axis 19 from the proximal end 46 to the distal end 48. The cylindrical body portion 40 may include a distal segment 42, defining a distal bore segment 21 and a proximal segment 43 defining a proximal bore segment 15. The distal bore segment 21 has an open distal end, through which firearm projectiles may exit the bore 41 of the suppressor 20. The proximal bore segment 15 may have an open proximal end and may be sized, configured, and/or designed to receive the distal end or muzzle of a firearm barrel. The proximal body segment 43 and/or the proximal bore segment 15 may also include mounting structure for coupling or securing the suppressor 20 to the firearm barrel. For example, proximal body segment 43 and/or proximal bore segment 15 may include threads, thereby defining a threaded portion 18. The threaded portion 18 may be threadingly engageable with a distal portion of a firearm barrel 10, which can be complementarily threaded, for coupling the suppressor 20 to a firearm barrel 10. As can be appreciated, the firearm barrel 10 includes a bore 13 including a central longitudinal axis 17. The proximal body segment 43 and/or the proximal bore segment 15 and/or the mounting structure, such as the threaded portion 18, may be designed such that when the firearm suppressor 20 is attached to the firearm barrel 10, the central longitudinal axis 19 of the bore 41 may be aligned with the central longitudinal axis 17 of the bore 13 of the firearm barrel 10. As can also be appreciated, the bore 41 will generally have a diameter that is at least as large, and in most cases larger than, the diameter of the bore 13 of the firearm to which it is intended to be attached. The alignment and sizing of the bore 41 may reduce the likelihood of a projectile undesirably striking or contacting any portion of the suppressor 20 as it passes through the suppressor 20 from the firearm.

The internal component 24, external component 22 and/or both may include structure to increase the surface area and/or promote cooling of the suppressor. For example, the internal component 24 may include cooling openings and/or cooling fins to increase the surface area of the internal component to promote the dissipation of heat. For example, the internal component 24 may include one or more cooling openings 58, defining corresponding cooling fins, which are defined in the wall 47 of the cylindrical body portion 40 at the proximal end 43 thereof. The cooling openings 58 may be defined by and extend into the wall 47 generally parallel to and radially offset from the proximal segment 15 of the bore 41. The cooling openings 58 may help increase surface area, and may define "cooling fins" to help dissipate heat. In particular, the proximal segment 43 will absorb heat from the hot gasses and from the firearm barrel which will heat up as the firearm is fired, and these cooling openings 58 and/or cooling fins provide an increased surface area to aid in the radiation and/or dissipation of this heat.

The internal component 24, the external component 22, or both, may also include mounting structure for either permanently or selectively coupling, attaching, or securing the external component 22 to the internal component 24. For example, in the embodiment shown in FIG. 2, the internal component may include a proximal flange 50 and a distal flange 60. An outer diameter of the flanges 50 and 60 may generally match an inner diameter of the external component 22. As such, when the external component 22 is disposed over the internal component 24, the outer surface of the flanges 50 and 60 may come close to, or into mating engagement with, the inner surface of the external component 22, for example at attachment points 11. Various techniques, such as welding, brazing, soldering, adhesive bonding, friction fitting, mechanical interlocking, threading, or the like, may be used to couple or attach the external component 22 to the internal component 24, for example at attachment points 11, or at other locations, points or structures along the length of the internal component 24 and/or the external component 22. For example, in some embodiments, the external component 22 and internal component 24 may be welded together at attachment points 11. In other embodiments, the outer surfaces of one or both of the flanges 50 and/or 60 may be threaded, and a portion of the inner surface of the external component 22 may be complementarily threaded, such that the external component 22 may be threadingly engageable with one or more of the flanges 50/60 of the internal component 24. In some embodiments, it is contemplated that the external component 22 may be designed to be engageable with the helical portion 44 of the internal component 24, and attached thereto. For instance, the outer diameter of the helical portion 44 may generally match the inner diameter of the external component 22. In some cases, the inner surface 28 of the external component 22 may include thread structures designed to engage the helical portion 44 in a threading fashion. Alternatively or additionally, the external component 22 may be welded, soldered, brazed, adhesively bonded, friction fitted, or otherwise attached to the helical portion 44. As suggested above, in other embodiments, mechanical interlocking, or the like, may be used to couple or attach the external component 22 to the internal component 24. For example, the embodiment shown in FIGS. 9 and 10, and discussed below, uses a two part internal component, wherein the two parts are threaded together to create a mechanical interlock to couple the external component 22 to the internal component 24. (see below). In general, it should be understood that a broad variety of techniques may be used to couple the external component 22 and the internal component 24. Additionally, increased points of contact between the external component 22 and the internal component 24, for example at the flanges 50/60 and/or at the helical portion 44, may increase heat transfer from the internal component 24 to the external component 22, and aide in the dissipation of heat.

As indicated above, the internal component 24 may include a helical portion 44 extending helically around the cylindrical body portion 40. The helical portion 44 defines at least one, and in some embodiments, a plurality of helical turns extending helically around the cylindrical body portion 40, with each turn extending 360 degrees around the longitudinal axis 19 of the body portion 40 in a helical manner. The number of turns, or partial turns, can vary in different embodiments. For example, the embodiment shown in FIGS. 2 and 5-8A includes 14 full turns. However, this number of turns may vary in other embodiments. For example, it is contemplated that the helical portion 44 may include as many or as few turns, or partial turns, as needed, to gain the desired suppressor performance for a particular application. By way of example only, in some embodiments, the number of turns may be in the range of 1 to 30 turns, or in some cases in the range of 5 to 25 turns, or in some cases in the range of 10 to 20 turns. In general, an increased number of turns may increase the surface area of the helical portion 44, which may aide in the attenuation of gasses and the dissipation of heat in some cases.

The pitch of the helical portion 44 may be constant along the length of the helical portion, or may vary, either in a stepwise manner, or in a tapered or constantly changing manner. For example, the pitch may increase or decrease gradually or rapidly, either in the proximal or distal direction, as desired. In some embodiments, the helical portion 44 may have a pitch in the range of about 0.1 to about 0.6, or in some cases, in the range of about 0.2 to about 0.5. In the embodiment shown, the helical portion 44 may have a constant pitch of about 0.3 to about 0.4, for example 0.33.

The helical portion 44 can extend helically around the cylindrical body portion 40 in either a right hand threading or twist, or a left hand threading or twist, as desired. The embodiment shown in FIGS. 2, and 5-8A shows a left hand twist to the helical portion 44, while the embodiment shown in FIGS. 9 and 10 (discussed below) show a right hand twist to the helical portion 44. It should be understood that the direction of the twist in either embodiment could be reversed, as desired. In some cases, the direction of the twist of the helical portion 44 may be designed to provide a self-tightening feature of the suppressor 20 to the firearm to which it is coupled when the firearm is fired. As can be appreciated, as the firearm is fired, pressurized hot gasses will enter the attenuation chamber 92 and engage the helical portion 44, and impart some rotational force on the suppressor 20. The direction of the twist of the helical portion 44 may be designed such that the rotational force applied to the suppressor 20 would be in the direction that would tighten the suppressor 20 to the firearm, rather than in the direction that would loosen it. For example, if the firearm barrel has a left hand threading for engagement with the threaded portion 18, the threaded portion 18 would have a corresponding left hand female threading for accepting the barrel. The helical portion 44 may then be designed with a left hand twist, such that when the firearm is fired, a tightening force may be applied to further tighten the suppressor 20 to the barrel 10. Similarly, if the firearm barrel has a right hand threading for engagement with the threaded portion 18, the threaded portion would have a corresponding right hand female threading for accepting the barrel, and the helical portion 44 may then be designed with a right hand twist, such that when the firearm is fired, a tightening force may be applied to further tighten the suppressor 20 to the barrel 10.

Figure 8:
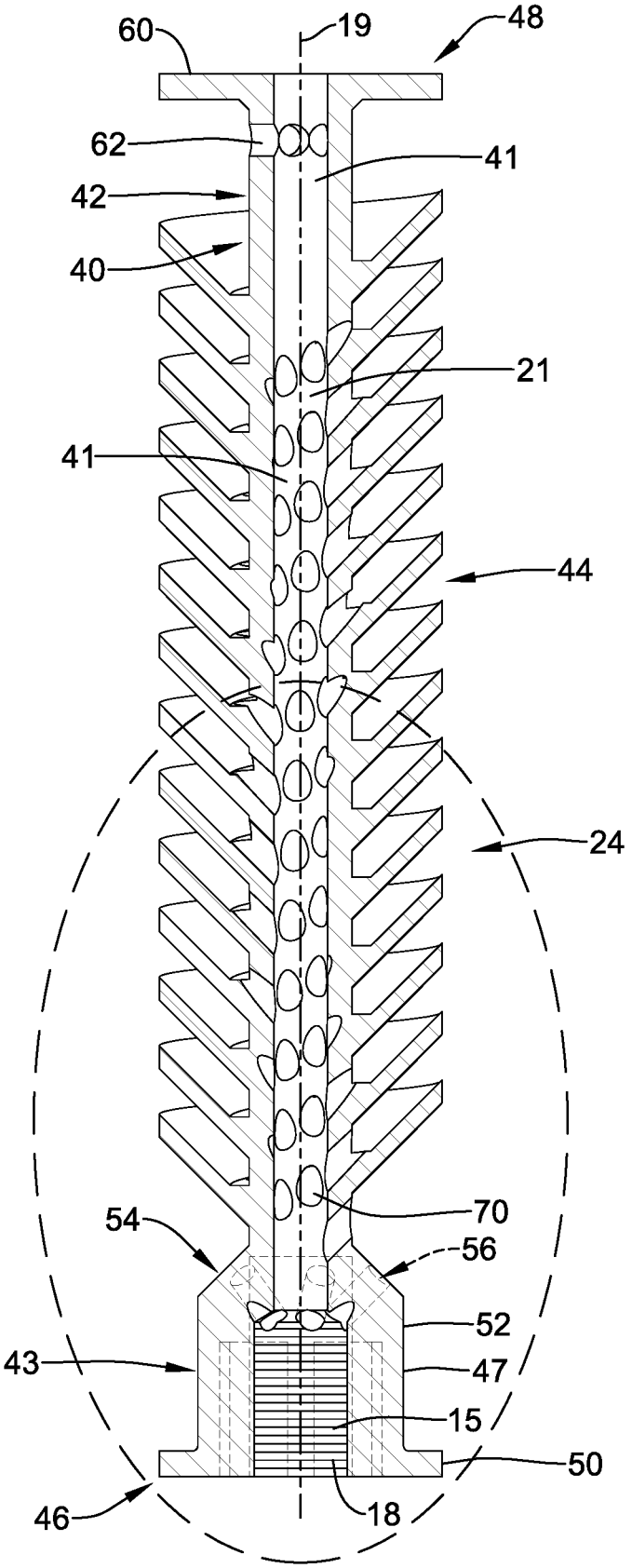
FIG. 8 is a cross-sectional side view the internal component of the firearm suppressor of FIG. 1, removed from the outer component.
Figure 8A:
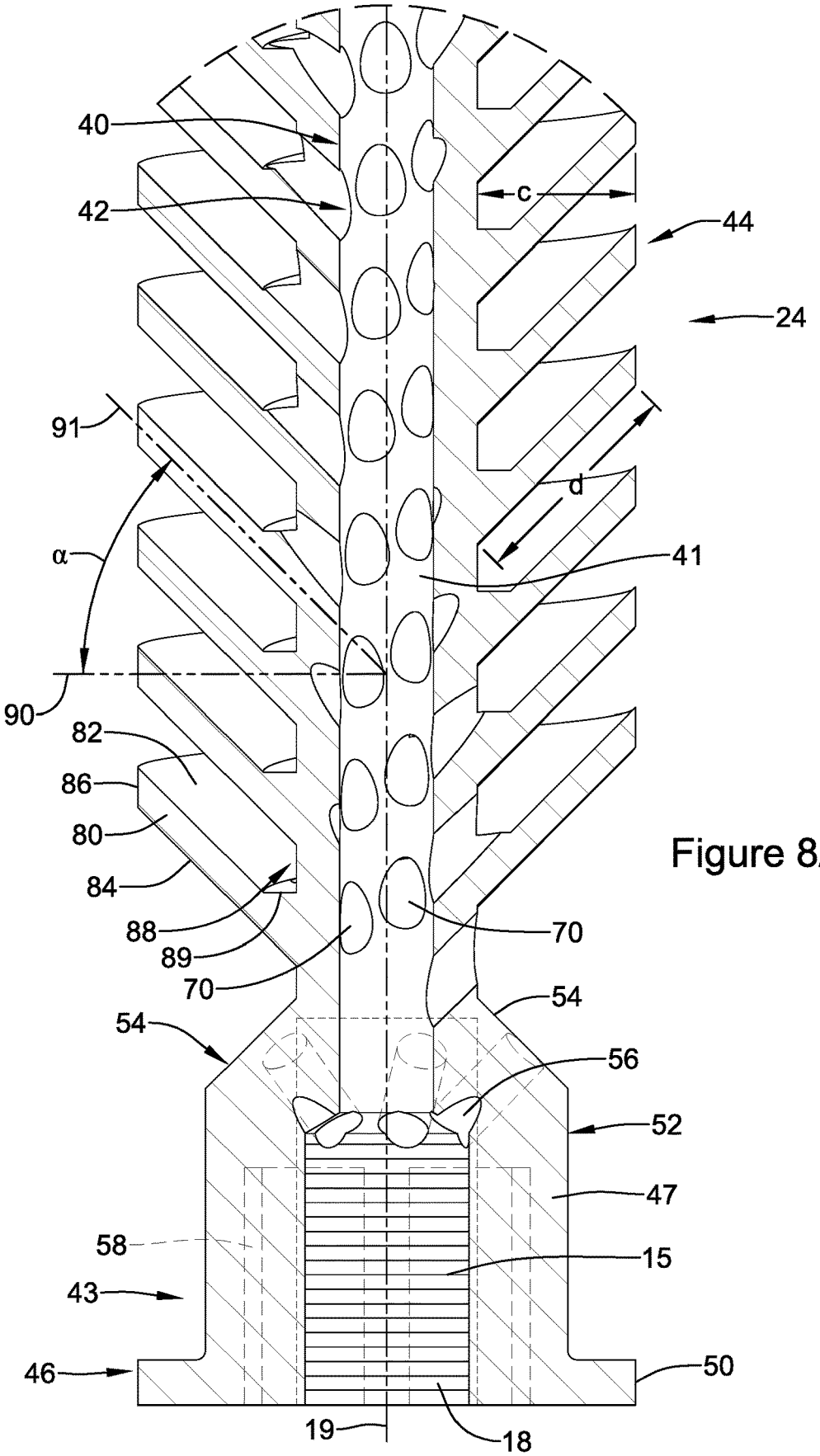
FIG. 8A is an expanded cross-sectional side view of a portion of the internal component shown in FIG. 8.

With reference now in particular to FIG. 8A, the helical portion 44 can include a body portion 80 defining a distal face or surface 82, a proximal face or surface 84, a crest 86, a base 89, and a root 88. Due to the nature of a helix, the body portion 80, including the surfaces 82 and 84, and the crest 86 and root 88, all extend helically about and/or around the cylindrical body portion 40 and/or longitudinal axis 19.

In some embodiments, in addition to extending helically about and/or around the cylindrical body portion 40, least a section of the helical portion 44 can be canted such that it extends radially outward from the cylindrical body portion 40 at an oblique angle relative to a plane normal to the central longitudinal axis 19 of the suppressor 20. For example, as can be particularly appreciated in the cross sectional side view shown in FIG. 8A, the helical portion 44 can be canted such that it extends radially outward from the cylindrical body portion 40 at an oblique angle $\alpha$ relative to a plane 90 normal to the central longitudinal axis 19 of the suppressor 20. Stated another way, the body portion 80 of the helical portion 44, when seen in cross-sectional side view, extends radially outward from the cylindrical body portion 40 at an oblique angle $\alpha$ relative to a plane 90 normal to the central longitudinal axis 19 of the suppressor 20. For example, at a point along the helical portion 44, the helical portion defines the crest 86, which may be the surface of the helical portion furthest from the cylindrical body portion 40, and the base 89, which may be the part of the body 80 of the helical portion 44 closest to the cylindrical body portion 40, and wherein the helical portion 44 (or the body 80 thereof) is canted such that a line 91 drawn from the central longitudinal axis 19, through a midpoint of the base 89, and through the midpoint of the crest 86 defines an oblique angle $\alpha$ relative to a plane 90 normal to the central longitudinal axis 19. For an additional example, the helical portion 44 may be canted when viewed in cross section from the side, such that the body portion 80 has a central longitudinal axis 91 that defines an oblique angle $\alpha$ relative to a plane 90 normal to the central longitudinal axis 19. As can be appreciated, the helical portion is canted distally in the embodiment shown, but in other embodiments may be canted proximally.

In some embodiments, as shown, both the distal surface 82 and the proximal surface 84 are canted such that they extend radially outward from the cylindrical body portion 40 at an oblique angle relative to a plane normal to the longitudinal axis 19. In some embodiments, the distal surface 82 and the proximal surface 84 are canted at the same oblique angle relative to a plane normal to the longitudinal axis, while in other embodiments, the distal surface 82 and the proximal surface 84 are canted at different oblique angles relative to a plane normal to the longitudinal axis 19. In some embodiments, the distal surface 82 is canted distally, or in other embodiments, may be canted proximally. Furthermore, in some embodiments the proximal surface 84 is canted distally, or in other embodiments, may be canted proximally. In the embodiment shown, both proximal and distal surfaces 82 and 84 are canted in the same direction, distally, and generally at the same angle, $\alpha$. But it should be appreciated that in other embodiments, these surfaces may be canted proximally, may be canted in different directions from one another, or possibly in the same direction, but at different angles relative to one another.

The degree and direction of cant can vary as desired. In some particular embodiments, the cant angle (whether proximally or distally) may be in the range of about 10 to about 80 degrees, in the range of about 30 to 60 degrees, or in the range of about 40 to 50 degrees. For example, the angle $\alpha$ may fall within any of these cant angle ranges. In the particular embodiment shown, the angle $\alpha$ is shown as being 45 degrees. As indicated above, the angle $\alpha$ may be in either a distal or proximal direction relative to a plane normal to the central longitudinal axis 19.

The canting of the helical portion 44, as discussed above, may provide a mechanism by which the exposed surface area of the internal component 24, and in particular of the helical portion 44 of the inner member, can be increased. For example, by canting the helical portion 44 either distally or proximally, the size of the surfaces 82 and 84 can be increased. This increase in surface area may aid in the attenuation of hot gasses, and the dissipation of heat. In some embodiments, the total exposed surface area of the helical portion 44, including the combined surface area of the distal face 82, the proximal face 84, the crest 86, and the root 88, is in the range of 40 to 70 inches$^2$, or for example, in the range of 50 to 65 inches$^2$. In some particular embodiments, the total exposed surface area of the helical portion 44 is 57 inches$^2$.

Referring back to FIG. 2, when the internal component 24 is disposed within the external component 22, the empty space left open within the lumen 26 of the external component 22 between the cylindrical body portion 40 and the inner surface of the external component 22 the defines the attenuation chamber 92. As can be appreciated, the shape of at least a portion of the attenuation chamber 92 is defined by the helical portion 44, and as such, a substantial portion of the attenuation chamber 92 is helical in shape. This helical design of the attenuation chamber allows for the continuous flow of gasses through the suppressor 20. Because there are no separate isolated chambers, which are common in suppressors with a baffle design, localized pressure spikes can be reduced or prevented, in particular compared to many baffle designs. Additionally, the canting of the helical portion may also aid in the flow of gasses through the suppressor in a desired direction, further attenuating and dissipating pressure spikes and heat. As such, the helical design and/or canted helical design may reduce back pressure, may reduce suppressed cyclic rate, may reduce gas blowback, may reduce felt recoil, and may reduce bolt velocity increases. In some cases, bolt velocity increases of less than 15% are achieved, and in some instances, bolt velocity increases of 13% or less are possible.

As indicated above, the cylindrical body portion 40 may also define or include one or more channels that extend from the bore 41 through the cylindrical body portion 40 and into the attenuation chamber 92, to allow for fluid communication between the bore 41 and the attenuation chamber 92. For example, the cylindrical body portion 40 may include a cylindrical wall 47 including an inner surface defining the bore 41, and an outer surface, and the cylindrical wall 47 may define or include at least one channel extending through the cylindrical wall 47 from an opening in the inner surface (from the bore) of the cylindrical body portion 40 to an opening in the outer surface of the cylindrical body portion 40, into the attenuation chamber 92. Some examples of the one or more channels include one or more of any of the channels 56, 70, and/or 62 as shown, for example in various figures, including FIG. 8.

One example type of channel includes channels 56, which extend through the cylindrical wall 47 in the proximal segment 43 of the body 40, proximal to the helical portion 44. In this particular embodiment, the proximal segment 43 includes a widened constant diameter portion 52 in which the proximal segment 15 of bore 41 is defined, and a transition portion 54 extending and tapering distally from the widened portion 52. The one or more channels 56 may extend from an opening in the proximal segment 15 of bore 41 through the wall 47, in particular through the wall at the transition portion 54, and into the attenuation chamber 92. These channels 56 may allow for hot, pressurized, expanding gasses leaving the muzzle when the firearm is fired to enter into the attenuation chamber 92 near the proximal end thereof. Additionally, these channels 56 may allow for an increase in surface area and/or an increase in fluid flow there through that aid in dissipation of heat, for example, from the barrel of the firearm. The number of channels 56 can vary, from none, to as many as are desired. In some particular example embodiments, there can be between 2 and 8 such channels 56.

Another example type of channel includes channels 70, which extend through the cylindrical wall 47 in the distal segment 42 of the body 40, within the helical portion 44. In particular, the distal segment 42 includes the helical portion 44 disposed thereabout, and the one or more channels 70 may extend from an opening in the distal segment 21 of bore 41 through the wall 47, and into the attenuation chamber 92. In some embodiments, the channels extend from an inner opening along the bore 41 to an outer opening along the root 88 of the helical portion 44. For example, the channels 70 may open into the root 88 defined by the helical portion 44. These channels 70 allow for hot, pressurized, expanding gasses to exit the bore 41 and enter into the attenuation chamber 92 within the helical portion 44. The number of channels 70 can vary, from none, to as many as are desired. In some particular example embodiments, there are in the range of about 10 to about 80 total channels 70. In some embodiments, there can be between 1 and 6 such channels 70 defined in every turn of the helical portion 44. For example, in the particular embodiment shown, there are on average 4.7 channels 70 in every turn of the helical portion 44, for a total of 66 channels 70 along the length of the helical portion. As can be appreciated, because the channels extend into the root 88 of the helix, they may therefore be disposed in a helical pattern about the bore 41. For example, if there are a plurality of channels 70 extending into the root 88 of the helical portion, the plurality of inner openings of the channels 70 along the bore 41 will be disposed in a helical pattern, because they are following the helical orientation of the root 88. Similarly, the outer openings of the channels 70 along the root 88 will likewise be disposed in a helical pattern, again following the helical orientation of the root 88.

Another example type of channel includes channels 62, which extend through the cylindrical wall 47 in the distal segment 42 of the body 40, distally of the helical portion 44. In particular, the distal segment 42 includes the helical portion 44 disposed thereabout, and the one or more channels 62 may extend from an opening in the distal segment 21 of bore 41 through the wall 47, and into the attenuation chamber 92 distally of the helical portion 44. In some embodiments, the channels 62 extend from an inner opening along the bore 41 to an outer opening along the distal segment 42 distal of the helical portion 44. These channels 62 may allow for fluid communication between the bore 41 and into the attenuation chamber 92, distal of the helical portion 44. It is theorized that in some cases, these channels or relief holes 62 may allow for any ambient air located in the bore 41 before the firearm is fired to be released into the attenuation chamber 92 upon the firing of the firearm, possibly reducing and/or eliminating flash when the firearm is fired. The number of channels 62 can vary, from none, to as many as are desired. In some particular example embodiments, there can be between 2 and 8 such channels 62. It should be understood that while they may, not all embodiments will include each of these different types of channels 56/70/and/or 62.

The one or more channels 56/70/and/or 62 may be canted and/or extend at an angle relative to the longitudinal axis 19. For example, the one or more channels 56/70/and/or 62 may be canted at an oblique angle relative to a plane normal to the central longitudinal axis 19. For example, the one or more channels 56/70/and/or 62 may extend radially outward from the bore 41 at an oblique angle relative to a plane normal to the central longitudinal axis 19 of the suppressor 20. For example, the channels 56/70/and/or 62 may extend from an inner opening in the bore 41 to an outer opening in the surface of the cylindrical portion 40, and the center of the outer opening is longitudinally offset (e.g. either proximally or distally) relative to the center of the inner opening. In the embodiment shown, the channels 56 and 70 are canted distally, such that the center of the outer opening is distal to the center of the inner opening of any individual channel 56/70. In other embodiments, the channels 56/70 may be canted proximally, such that the opposite would be true, or may not be canted. Also in the embodiment shown, the channels 62 are not canted, but rather extend parallel to a plane normal to the central longitudinal axis 19. However, in other embodiments, these channels 62 may also be canted, as desired (either proximally or distally). In some embodiments, the angle of the cant of the channels 56/70/and/or 62 may be similar to angle α discussed above regarding the helical portion 44. For example, in some particular embodiments, the cant angle of the channels 56/70/and/or 62 (whether proximally or distally) may be in the range of about 10 to about 80 degrees, in the range of about 30 to 60 degrees, or in the range of about 40 to 50 degrees. In the particular embodiment shown, the cant angle of the channels 56 and 70 is about 45 degrees, while the channels 62 are not canted. In some embodiments, the cant angle of the channels 56/70/and/or 62 may generally match the angle α of the helical portion 44.

Additionally, or alternatively, the one or more channels 56/70/and/or 62 may be disposed at an angle such that the inner and outer openings of a particular channel 56 are rotationally offset from one another. For example, the channels 56/70/and/or 62 may extend from an inner opening in the bore 41 to an outer opening in the surface of the cylindrical portion 40, and the center of the outer opening is rotationally offset relative to the center of the inner opening about the longitudinal axis 19. In some embodiments, this angle may generally follow the pitch angle of the helical member 44. Additionally or alternatively, the direction of this angle may generally follow the direction of the twist orientation of the helical member 44. This may also add to a self tightening aspect of the suppressor, as gasses flow through the channel. In particular, the rotational angular orientation of the channels may aid in creating a force that rotates the suppressor in a tightening direction as gasses flow though the channels. Some example ranges for these angles include in the range of about 10 to about 80 degrees, or in the range of about 30 to about 60 degrees.

The channels 56/70/and/or 62, while shown as generally circular in cross-sectional shape, may be made to include any of a broad variety or cross sectional shapes. For example, the cross-sectional shape of any one or more of the channels 56/70/and/or 62 may be generally square, triangular, or any of a broad variety or other polygon shapes, or may define a generally oval, circular, oblong, c-shaped, or other curved shape as desired. The shape and size of the of the channels may be chosen and/or designed to accommodate the desired amount of fluid flow between the bore 41 and the attenuation chamber 92 and/or the desired amount of surface area for heat attenuation. Additionally, the shape, size, or orientation of any plurality of channels 56/70/and/or 62 within the same suppressor 20 may vary from one another, as desired.

Figure 9:
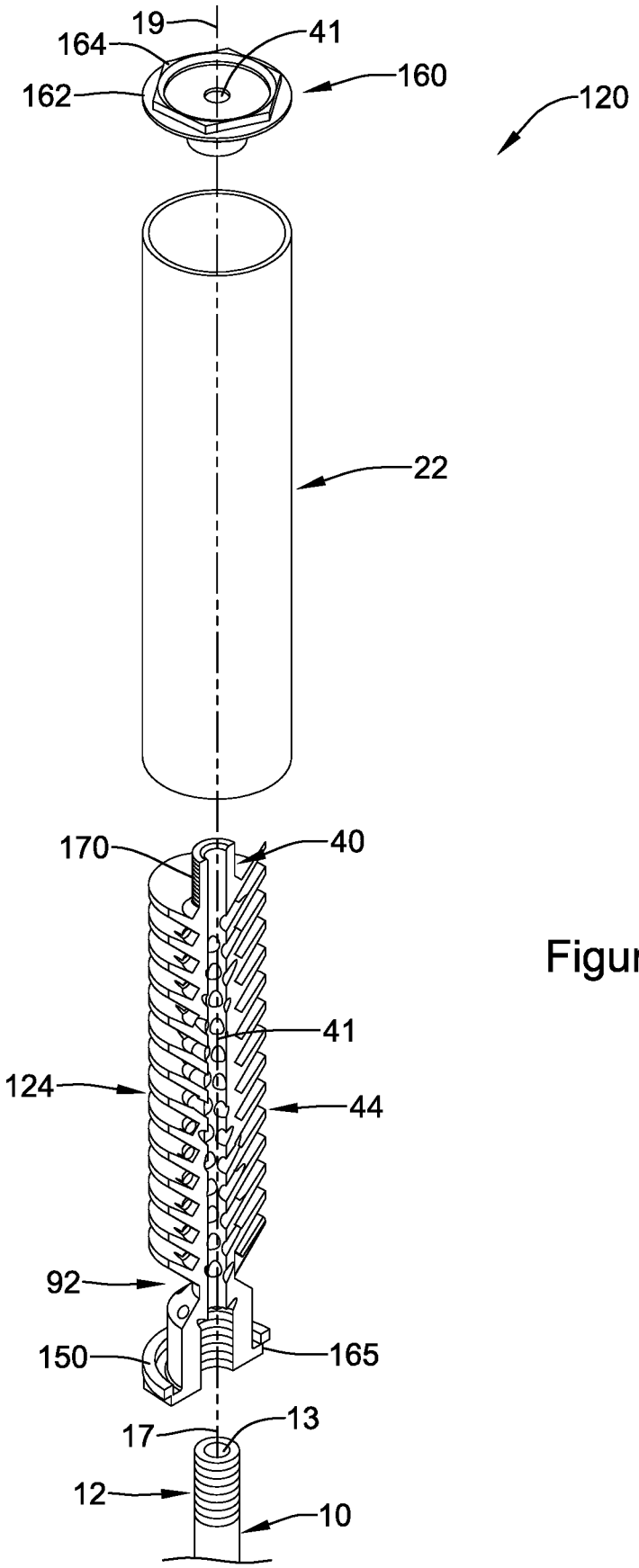
FIG. 9 is an exploded perspective view of an alternative embodiment of a firearm suppressor, showing the internal component in cross-section.

Reference is now made to FIG. 9, which shows an alternative embodiment of a suppressor 120. The suppressor 120 is very similar to the suppressor 20 discussed above, and in that regard, all of the information and discussion above regarding the suppressor 20 applies to the suppressor 120, except for a few points of distinction. The primary distinction between these two embodiments is that the embodiment shown in FIGS. 9 and 10, uses a slightly different mechanism for coupling the external component 22 to the internal component 124. In particular, in the suppressor 120, the internal component 124 does not include a distal flange 60 as in the suppressor 20, but rather, includes a removable end cap 160. The end cap includes a flange 162, and the internal component 124 includes a flange 150. The end cap 160 further includes a threaded bore 172 (FIG. 10) that is configured to threadingly engage a threaded portion 170 disposed on the distal end of the cylindrical body portion 40. The outer diameter of the flanges 162 and 150 are slightly larger than the inner diameter of the external component 22. When the external component 22 is disposed over the internal component, the end cap 160 can be treaded onto the threaded portion 170. The external component 22 is thereby captured between the flanges 162 and 150, to thereby couple the external component 22 to the internal component 124.

The end cap 160 may also include one or more engagement features to aid in tightening the end cap on the threaded portion 170. For example, the end cap 160 may include a raised portion extending from the flange 162 that defines one of more flats 164 that may be engaged by a tool to aid in tightening the end cap to the threaded portion 170 of the cylindrical body portion 40. Similarly, the proximal flange 150 may similarly include flats 165 that may be engaged by a tool to aid in tightening the end cap to the threaded portion 170 of the cylindrical body portion 40 and/or to aid in tightening of the suppressor 120 to a firearm barrel.

Figure 10:
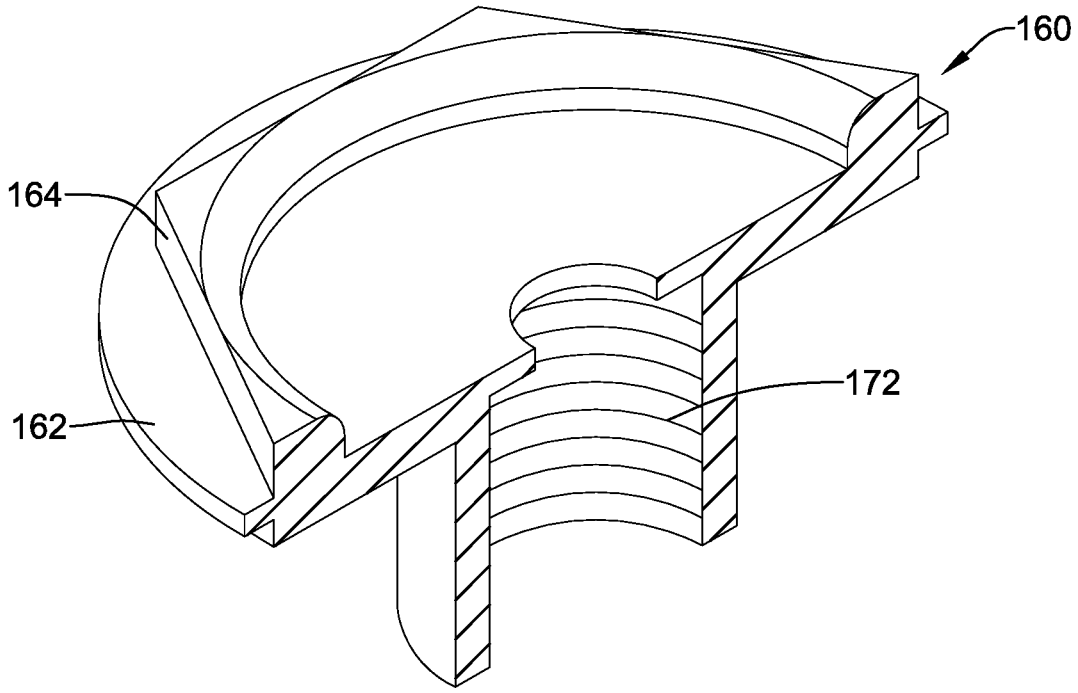
FIG. 10 is a perspective cross-sectional view of the end cap of the firearm suppressor of FIG. 9.

Two other slight distinctions between the suppressor 120 and the suppressor 20 are that the suppressor 120 shown in FIGS. 9 and 10 does not include any distal channels 62, and the twist orientation of the helical portion 44 in the suppressor 120 is shown as a right handed twist, as opposed to the left handed twist shown in the suppressor 20. It should be understood that other than the noted differences, all information regarding the suppressor 20 applies to the suppressor 120, and vice versa. Additionally, the use of any of the features of one example embodiment may be used in the other embodiments.

As has been suggested above, the suppressors 20 and/or 120 are designed to attenuate hot expanding gasses produced form the firing of the firearm, and dissipate them. For example, internal component is designed to attenuate hot expanding gasses, and allow expanding gasses to escape the bore of the suppressor and be transferred to the attenuation chamber. The canted helix allows for a large amount of surface area to attenuate (absorb and dissipate) the heat of the expanding gases from firing.

The velocity of the expanding gasses is decelerated outward through the volume of the attenuation chamber to be dissipated by the external component. In at least some embodiments, the combustive ambient air is retained in the attenuation chamber of the suppressor, and is not allowed to escape through the distal end of the system before combustion, therefore reducing or eliminating flash.

The suppressor 20 and/or 120, or the components thereof, may be formed or made using any of a wide variety of manufacturing techniques and/or materials. For example, the suppressor or components thereof may be made by machining, such as CNC machining, lathing, molding, such as injection molding, casting, milling, stamping, die cutting, 3D printing, laser cutting, bending, cold working, drilling, or other desired processes. The suppressor, or components thereof, may be formed from any of a variety of materials, such as a metallic material including one or more metal or metal alloy, such as aluminum or aluminum alloys, tin or tin alloys, iron or iron alloys, including steel, such as stainless steel, carbon steel, beryllium or beryllium alloys, titanium or titanium alloys, or the like or others; or a polymeric material including any of a broad variety or thermoplastic or thermosetting polymers, some examples of which may include polyvinylchloride (PVC), polycarbonates, polyether ether ketone (PEEK), polyurethane, polyethylene (PE), ultra-high molecular weight polyethylene (UHMWPE), polypropylene (PP), polyethylene terephthalate (PET), polyamide, polyether block amide (PEBA), polyimide, nylon, or mixtures or blends or copolymers thereof; or a metal-polymer composite; fiberglass; ceramics; wood; laminates; combinations or composites thereof, or the like, or other suitable material.

In embodiments where different portions are made of different materials, the different portions can be connected using a suitable connecting technique and/or with a connector or fastener. For example, the different portions can be connected using welding (including laser welding), soldering, brazing, adhesive, various fasteners or fasting or securement techniques, such as screws, bolts, rivets, or the like, or combinations thereof.

In some embodiments, external component 22, the internal component 24 or 124, or both, can be or unitary and/or monolithic construction. For example, the helical portion 44 can be formed integrally with the cylindrical body portion 40 for the formation of the internal component 24 or 124. For example, the cylindrical body portion 40 and the helical portion 44 may be formed from a single piece or billet of material and as such be of unitary or monolithic construction. Any of a variety of manufacturing techniques may be used to construct such monolithic structures. Some particular examples include the use of a computer numerically controlled (CNC) machine or center, or a lathe, or the like. The one piece core and/or internal component design may increase strength, heat dissipation, and simplicity. The single piece billet would include no welds or other such attachment points which may fail, and would not include multiple parts to complicate its construction and use. The single piece core and/or internal component design would better allow the suppressor to heat evenly along its entire length, with fewer "hot spots", thereby increasing the suppressors heat transfer efficiency.

In some embodiments, the exterior surface may be coated, textured, treated or otherwise given a finish as desired. For example, a coating, for example a protective or other type of coating may be applied over portions or the entire adapter. Likewise, the surface may be etched, checkered, sandblasted, beadblasted, sodium bicarbonate-blasted, electropolished, plated, or the like, as desired. Aestetic features may be included, such as coloring, shaping, etc.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example embodiment being used in other embodiments. The invention's scope is, of course, defined in the language in which the appended claims are expressed.

What is claimed is:

1. A firearm suppressor comprising: a monolithic body including a proximal end and a distal end, the body defining a central bore extending from the proximal end to the distal end about a central longitudinal axis, the body including a distal segment, a proximal segment, and a transition portion disposed between the proximal segment and the distal segment; wherein the proximal segment includes a widened inner diameter portion in which a proximal bore is defined; the proximal bore segment being configured to receive a distal end of a barrel of a firearm such that the barrel extends within the proximal bore segment; and the body including a wall having an inner surface defining the proximal bore, and having an outer surface, the wall defining at least one channel extending through the wall from an opening in the proximal segment through the transition portion.

2. The firearm suppressor of claim 1, further comprising a housing disposed over at least a portion of the body such that an attenuation chamber is defined between the body and the housing.

3. The firearm suppressor of claim 2, wherein the at least one channel extends through the body from the proximal bore to the attenuation chamber such that the proximal bore and the attenuation chamber are in fluid communication through the at least one channel.

4. The firearm suppressor of claim 1, wherein the proximal bore has an inner diameter that is larger than an inner diameter of a distal bore defined in the distal segment.

5. The firearm suppressor of claim 1, wherein the at least one channel is canted at an oblique angle relative to a plane normal to the central longitudinal axis.

6. The firearm suppressor of claim 1, wherein as the at least one channel is canted distally as it extends through the wall from the inner surface in the proximal segment to the outer surface in the distal segment.

7. The firearm suppressor of claim 1, wherein the wall defines one or more cooling bores spaced from the central bore, the cooling bores extending into the wall offset from the central longitudinal axis.

8. The firearm suppressor of claim 7, wherein the one or more cooling bores extend into the wall such that they overlap with the majority of the proximal segment.

9. The firearm suppressor of claim 1, wherein the proximal segment includes mounting structure for coupling to the barrel of the firearm.

10. The firearm suppressor of claim 1, further comprising a helical portion extending helically around the body, at least a full turn of the helical portion being canted such that it extends radially outward from the body at an oblique angle relative to a plane normal to the central longitudinal axis.

11. The firearm suppressor of claim 10, wherein the one or more channels are disposed proximal to the helical portion.

12. The firearm suppressor of claim 10, further including an outer cylindrical housing portion disposed over at least a part of the helical portion.

13. The firearm suppressor of claim 11, wherein the wall defines at least one distal channel extending through the wall from the inner surface in the distal segment to the outer surface in the distal segment.

14. The firearm suppressor of claim 1, wherein the at least one channel includes in the range of 2 to 8 channels that extend through the wall from the inner surface in the proximal segment to the outer surface in the distal segment.

15. A firearm suppressor comprising:

a unitary inner body including a proximal end and a distal end, the body defining a central bore extending from the proximal end to the distal end about a central longitudinal axis, the body including a distal segment, a proximal segment, and a transition portion disposed between the proximal segment and the distal segment, the proximal bore being configured to receive a distal end of a barrel of a firearm within the proximal bore segment;

wherein the proximal segment includes a widened inner diameter portion in which a proximal bore is defined;

a housing disposed over at least a portion of the inner body such that an attenuation chamber is defined between the distal body segment and the housing; and at least one channel extending through the inner body from the proximal bore through the transition portion to the attenuation chamber.

16. The firearm suppressor of claim 15, wherein the proximal bore has an inner diameter that is larger than an inner diameter of a distal bore defined in the distal segment.

17. The firearm suppressor of claim 15, wherein the at least one channel is canted at an oblique angle relative to a plane normal to the central longitudinal axis.

18. The firearm suppressor of claim 15, further comprising a helical portion extending helically around the body and disposed within the housing, at least a full turn of the helical portion being canted such that it extends radially outward from the body at an oblique angle relative to a plane normal to the central longitudinal axis.

19. The firearm suppressor of claim 18, wherein the one or more channels are disposed proximal to the helical portion.

* * * * *